US008152399B2

(12) United States Patent
Lasfargues et al.

(10) Patent No.: US 8,152,399 B2
(45) Date of Patent: Apr. 10, 2012

(54) PACKAGING AND APPLICATION DEVICE

(75) Inventors: Leandre Lasfargues, Maisons Alfort (FR); Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 406 days.

(21) Appl. No.: 12/478,076

(22) Filed: Jun. 4, 2009

(65) Prior Publication Data

US 2009/0304432 A1 Dec. 10, 2009

(30) Foreign Application Priority Data

Jun. 5, 2008 (FR) ..... 08 53725

(51) Int. Cl.
*A46B 17/08* (2006.01)

(52) U.S. Cl. ..... 401/122; 401/118; 401/119; 401/120; 401/126; 401/129; 401/171; 401/176; 132/218; 132/317

(58) Field of Classification Search ..... 401/118–130, 401/171, 176, 178, 179; 132/218, 317
See application file for complete search history.

(56) References Cited

U.S. PATENT DOCUMENTS 3,246,657 A * 4/1966 Roller, Sr. ..... 401/176
5,247,951 A * 9/1993 Machida et al. ..... 132/218
5,636,931 A * 6/1997 Gueret ..... 401/130
7,114,505 B2 * 10/2006 Bauer et al. ..... 401/120
7,824,121 B2 * 11/2010 Ramet et al. ..... 401/122

FOREIGN PATENT DOCUMENTS

EP 0 002 301 A 6/1979
EP 0728427 A 8/1996
EP 1 714 578 A 10/2006

OTHER PUBLICATIONS

U.S. Appl. No. 12/878,790, filed Sep. 9, 2010, Lasfargues, et al.
International Search Report filed Feb. 23, 2009 in FR 0853725.

* cited by examiner

*Primary Examiner* — Steven J Ganey
(74) *Attorney, Agent, or Firm* — Oblon, Spivak, McClelland, Maier & Neustadt, L.L.P.

(57) ABSTRACT

The invention is a device for packaging and applying a product. The device includes a receptacle for containing the product and an applicator including a rod provided at one end with an application element. The receptacle further has a tubular body with a movable piston guided axially in the tubular body wherein the piston has a passage opening for the application element. The applicator includes an axial stop protruding radially relative to the rod and is capable of being in abutment against the piston. The stop can be retracted radially in order to allow it to pass through the passage opening of the piston and includes at least one orifice for the passage of air when the stop is in abutment against the piston.

21 Claims, 4 Drawing Sheets

PACKAGING AND APPLICATION DEVICE

FIELD OF THE INVENTION

The present invention relates to a device for packaging and applying a product, comprising:

a receptacle for containing the product to be applied;

an applicator comprising a rod which is provided at one end with an application element which can be introduced into the receptacle in order to remove the product, the receptacle comprising:

a tubular body;

a movable piston which is guided axially in the tubular body, which piston defines a passage opening for the application element and the rod, the applicator comprising, along the length of the rod, at least one axial stop which protrudes radially relative to the rod and which is capable of being in abutment against the piston along the periphery of the passage opening.

BACKGROUND OF THE INVENTION

The term packaging device is intended to refer to any packaging which allows the sale, the transport, the protection and the storage of the product which it contains.

The term application device is intended to refer to any device comprising means for applying and dispensing a composition, in particular a cosmetic composition, to keratinic materials, such as skin, or keratinic fibres (lashes, hair . . . ).

It is known, in particular from document FR 2 884 500, to provide a piston which slides in the tubular body of a receptacle which is intended to receive an applicator comprising an application element which is arranged at the end of a rod, so that, when the applicator is introduced, the tubular piston is moved along the body so as to compress the product stored in the receptacle. The product is thus confined to the bottom of the tubular body and is held in contact with the application element, whilst being separated from ambient air, which promotes the preservation thereof.

The use of such a piston is effective with regard to the removal of the product by the applicator and the preservation of the product. However, the travel of the rod of the applicator through the piston and movement of this piston generate excess pressure or reduced pressure within the receptacle, which lead to introduction or removal forces of the applicator relative to the receptacle which differ in accordance with the position of the applicator along the introduction or removal path thereof. This phenomenon which is referred to as "pulsing" is unpleasant for the user and can bring about irritating noises. Furthermore, the mechanical resistance counter to the movement of the applicator relative to the receptacle is perceived to be an irritation by the user.

The object of the invention is to provide a solution to this non-homogeneous nature of the retention forces applied to the applicator during the movement path thereof.

SUMMARY OF THE INVENTION

The invention relates to a packaging and application device of the above-mentioned type, wherein the stop can be retracted radially in order to allow it to pass through the passage opening of the piston and defines at least one orifice for the passage of air when the stop is in abutment against the piston.

According to specific embodiments, the packaging and application device comprises one or more of the following features:

the stop comprises, along the length of the rod, a radial widening which locally increases the cross-section of the rod and the at least one air passage orifice comprises at least one recess which is provided in the radial widening;

the radial widening has a plurality of separate lugs which are distributed at the periphery of the rod and which extend away from the shaft of the rod as far as radial tips in the direction of the application element, the lugs being separated by recesses which extend partially along the length of the rod;

the lugs have at the outer side a surface which diverges radially relative to the shaft of the rod in the direction of the application element;

the inclination of the lugs relative to the shaft of the rod is between 1 and 10 degrees;

the rod comprises a tubular casing and the lugs are integral with the tubular casing in the continuation thereof;

the radial tips constitute the free ends of the lugs;

the stop is radially resiliently deformable;

the retractable stop has a resistance to passage through the opening of the piston which is greater when the applicator is introduced into the receptacle than the passage resistance of the retractable stop though the opening of the piston, when the applicator is removed from the receptacle;

the piston comprises, upstream of the passage opening, when viewed in the direction in which the applicator is introduced into the receptacle, a guiding portion having a cross-section which decreases progressively as far as the passage opening, which portion forms a cam surface which is capable of providing radial retraction of the axial stop by means of co-operation with the stop when the applicator is introduced into the receptacle; and the passage opening comprises, along the periphery thereof, corrugations which are capable of pressing on the rod.

The invention will be better understood from a reading of the following description, given purely by way of example and with reference to the drawings.

DETAILED DESCRIPTION OF THE PREFERRED EMBODIMENT

Figure 1:
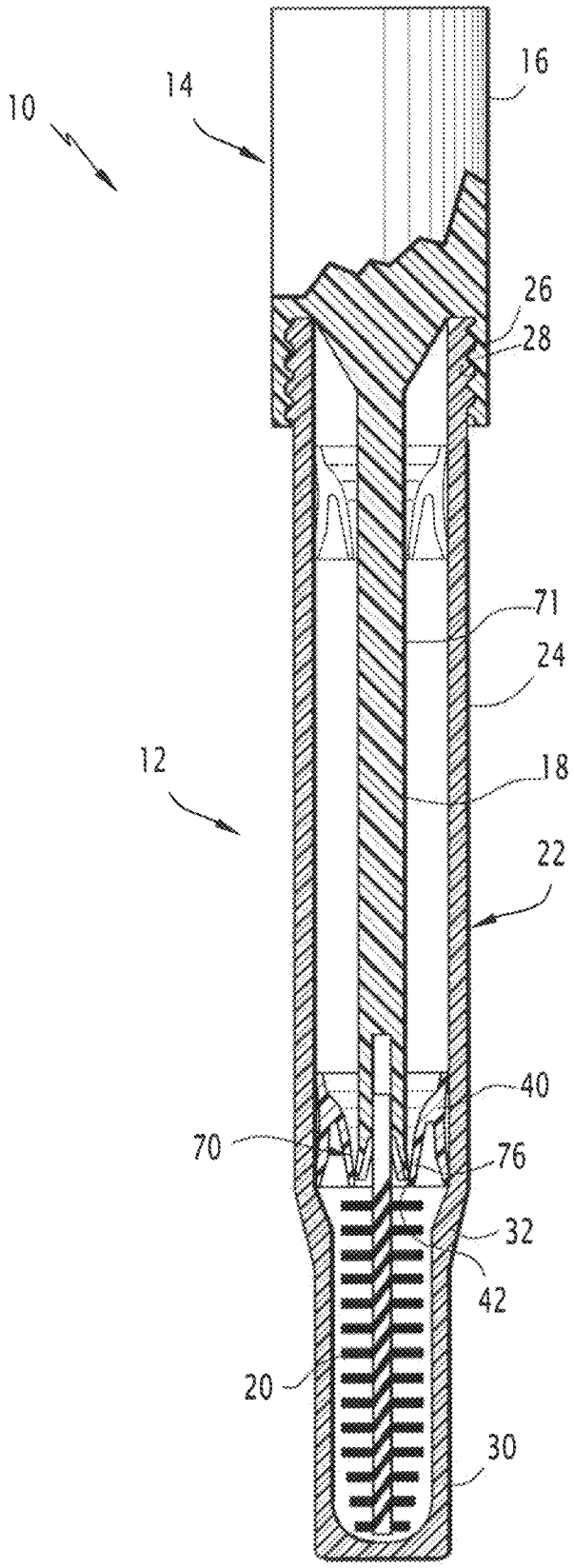
FIG. 1 is a longitudinal section of a packaging device according to the invention.

The application and packaging device 10 illustrated in FIG. 1 is, for example, intended to contain and allow the application of mascara or any other viscous cosmetic product. It comprises a receptacle 12 and an applicator 4 which, when in the rest state, is held screwed to the receptacle 12.

The applicator 14 comprises a stopper 16 which forms a gripping member and which is extended by a rod 18 which carries an application element 20 at one end. The rod 18 and the application element 20 are capable of being engaged in the receptacle 12, in particular in the position of FIG. 1.

In the example in question, the application element 20 comprises a mascara brush which comprises a twisted metal core and bristles which are retained transversely between the turns of the core. In a variant, the application element is an end-piece, which may or may not be flocked, or resiliently deformable, or a foam, or a felt or a soft brush or brush without any metal core, for example, a brush or a comb which is produced by plastics material being injection-moulded.

The receptacle 12 comprises a tubular body 22 which has a circular cross-section and which has a main portion 24 which is open at one inlet end. In the region of this inlet, it comprises at the outer side a threaded portion 26 which is capable of co-operating with a corresponding tapped portion 28 provided in the stopper 16 in order to allow the receptacle to be closed in a sealed manner by screwing the stopper 16 onto the receptacle 12.

At the other end thereof, the main portion 24 is extended by a well 30 which is constituted by a blind cylindrical portion having a smaller cross-section than that of the main portion 24. The well 30 is blocked at one end and is connected at the other end thereof to the main portion 24 by a convergent portion 32. The well 30 has an inner cross-section which is substantially equal to or only slightly greater than that of the application element 20.

The receptacle further comprises an axially sliding piston 40 which is arranged inside the main portion 24 and is axially guided thereby. The product to be applied is confined in the tubular body 24 between the piston 40 and the bottom of the well 30.

The piston 40 has an axial opening 42 for the passage of the application element 20 and the rod 18. The cross-section of the opening 42 is substantially equal to the cross-section of the rod 18 in the main portion thereof.

The piston 40 comprises an outer collar 44 which is extended at each end by two divergent lips 46, 48 which press in a resilient manner on the inner surface of the main portion 24, thereby bringing about the sealing between the piston 40 and the main portion 24. The collar 44 is thus slightly remote from the main portion 24 in the central portion of the piston.

The opening 42 is formed at the narrowed end of a generally frustoconical guiding portion 50 of the piston which is connected to the collar 44 by means of the widened end thereof which is directed towards the inlet of the receptacle. In this manner, the guiding portion 50 extends in the space of the collar 44 substantially over the entire length thereof. It has a circular cross-section which generally decreases from the inlet thereof which has a maximum diameter and which is directed towards the inlet of the receptacle as far as the opening 42.

Figure 3:
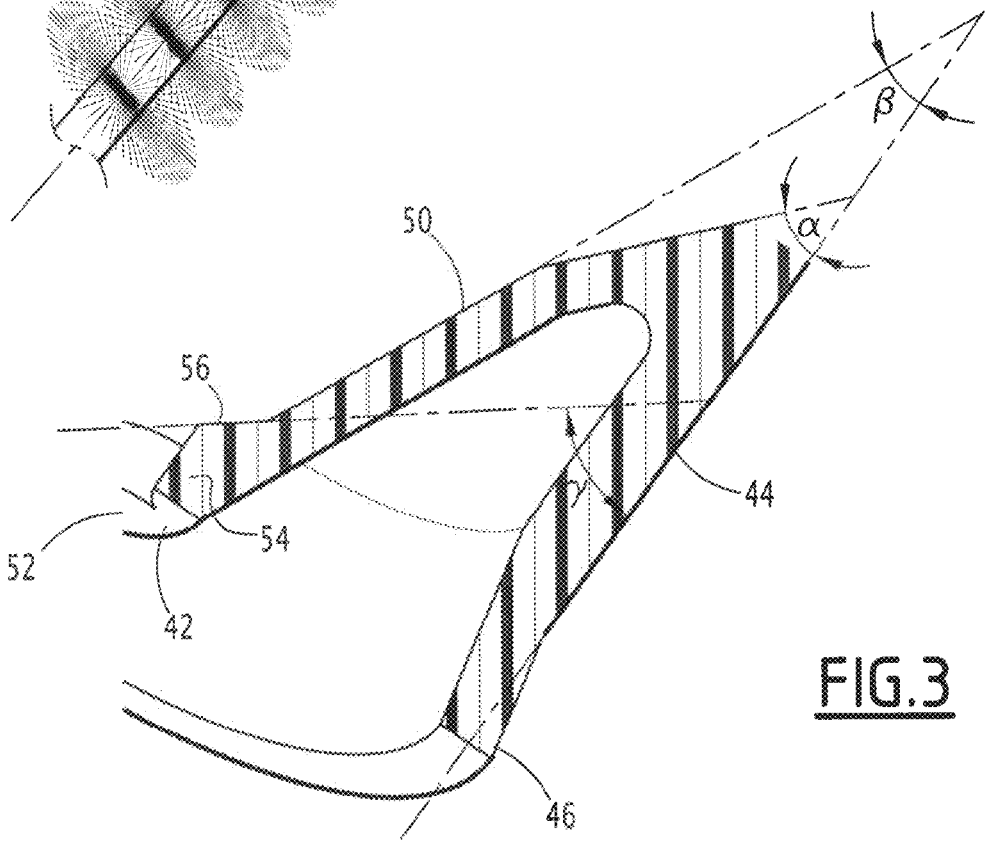
FIG. 3 is a sectioned enlarged view of the stop.

As illustrated in FIG. 3, the guiding portion has two successive portions with different opening angles. In this manner, the inlet portion opposite the opening 42 has an angle of inclination $\alpha$ relative to the longitudinal axis in the order of 45°, whilst the outlet portion which opens via the opening 42 has a smaller angle of inclination $\beta$ of between 20° and 40°.

The opening 42 has along the periphery thereof an assembly of regularly distributed corrugations which are capable of wiping the surface of the rod 18 by means of the upper surfaces of the corrugations and drying the application element 20.

The corrugations 52 are further capable of providing a flow of air between the rod and the piston.

As illustrated in FIG. 3, the inner surface around the opening 42 forms an inner shoulder 54 which extends inwards. The corrugations 52 are defined by this shoulder 54 so as to extend radially towards the opening 42.

The peak of the corrugations 52 and the peak of this shoulder 54 form a frustoconical abutment zone 56 for an axial stop of the application element.

This abutment zone 56 forms an angle $\gamma$ of between 20° and 60° with the longitudinal axis of the receptacle.

At the end thereof carrying the application element 20, the rod 18 has an axial stop 70 which protrudes radially relative to the main portion designated 71 of the rod 18, along which the cross-section of the rod 18 is constant. This axial stop is capable of being in abutment against the piston 40 along the periphery of the opening 42 on the abutment zone 56 and more generally on the inner surface of the guiding portion 50.

The stop is formed by a radial widening 70 which can be retracted radially by means of radial resilient deformation in order to allow the rod to pass through the piston.

More precisely, in the embodiment illustrated in the Figures, the axial stop is formed by an assembly of lugs 72 which extend the rod 18 and which are separated by air passage holes 76 when the stop is in abutment against the abutment zone 56. The lugs widen from the rod 18 as far as the free ends 78 thereof forming radial tips. At the free ends thereof, the lugs have a shoulder which is directed towards the application element 20 and which is capable of being in abutment against the abutment zone 56.

The lugs delimit externally a surface which diverges radially from the rod 18 as far as the free ends 78. In order to provide softening, the surface of the free ends 78 is chamfered or rounded.

The inclined surfaces form surfaces which are capable of co-operating with the periphery of the opening 42 on the abutment zone 56.

The lugs 72 are each radially deformable and are separated by recesses 82 which form the air passage orifices 76. The lugs 72 become deformed inwards upon contact with the opening 42. These recesses 82 extend at least partially along the length of the rod and open between the ends 78 of the lugs.

The rod has, in the main portion thereof, a tubular casing with which the lugs 72 are integrally moulded and constitute extensions thereof.

The lugs 72 have an inclination relative to the shaft of the rod of between 1 and 10 degrees, this inclination being less than the inclination of the convergent portion 50 which forms a cam surface which is capable of deforming the lugs 72 by co-operating with the free end 78 of the lugs when the applicator is pressed into the receptacle.

The lugs 72 have a length measured along the shaft of the rod of between 1 and 5 mm. Their width is substantially equal to the width of the recesses 82.

The recesses have a length, measured along the shaft of the rod, equal to that of the lugs and their width is between 1 and 3 mm at their opening end.

The resilience of the lugs 72 and the inclination of these lugs and that of the frustoconical surface 50 are such that, when the application element 20 is introduced into the receptacle 12, the force required for the retractable stop 70 to pass through the opening 42 is greater when the applicator is introduced than that required for the same passage when the applicator is removed.

It will be noted that, initially, the application element 20 is received in the well 30 of the receptacle.

When the receptacle is full, the piston is close to the inlet in the position illustrated with dot-dash lines in FIG. 1. When it is almost empty, the piston is pressed into the main portion 24 in the region of the well 30 as illustrated with solid lines in FIG. 1.

In order to use the applicator 14, it is removed from the receptacle. The traction on the rod 18 from the gripping member 16 brings about the travel of the rod 18 through the opening 42. During this travel, the rod is wiped by the corrugations which are provided on the periphery of the opening 42. The presence of the corrugations allows a circulation of air which prevents any pulsing effect. The corrugations are then cleaned when the brush passes.

The passage of the lugs 72 through the opening 42 takes place after that of the rod. Owing to their inclined outer surfaces, the lugs become radially deformed so that the ends 78 thereof move closer to the shaft of the rod 18 allowing the opening 42 to be passed. The bristles or other members of the application element also become resiliently deformed in order to pass through the opening 42. During this passage, they are subject, owing to the deformation, to a drying operation which limits the quantity of product removed by the application element.

Figure 2:
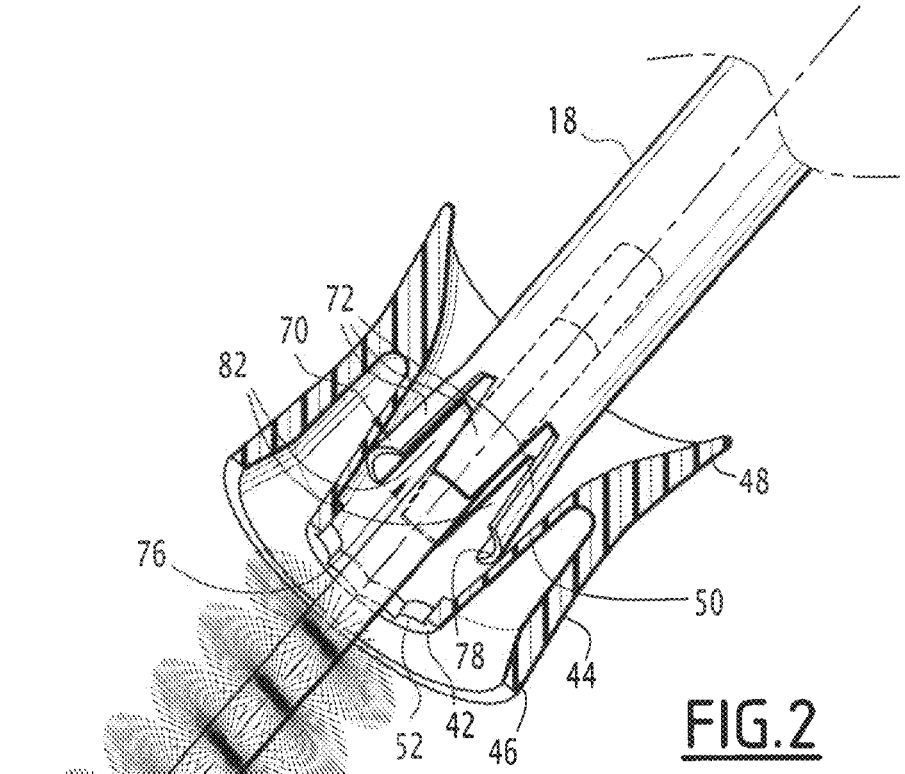
FIG. 2 is a larger scale perspective view of the stop of the applicator in abutment against the sliding piston.

When the applicator 14 is reintroduced into the receptacle 12 after use, the application element passes the opening 42 by becoming deformed, then the ends 78 of the lugs move into abutment against the convergent surface 50 as illustrated in FIG. 2. In accordance with the resilience of the lugs 72, the lugs become deformed and move downwards until they move into abutment against the abutment zone 56. They bring about the movement of the piston 40 under the action of the thrust of the rod, thus bringing about the compression of the product contained in the receptacle downstream of the piston.

Figure 4:
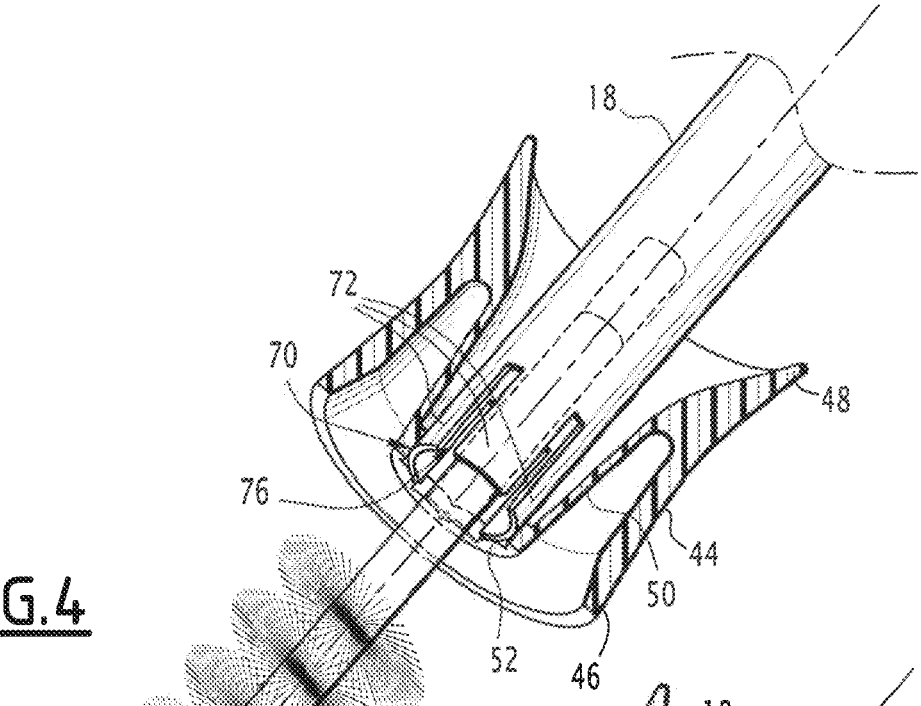
FIGS. 4 and 5 are views identical to that of FIG. 2 of the stop of the applicator as it passes the piston and after it has passed the piston, respectively.
Figure 5:
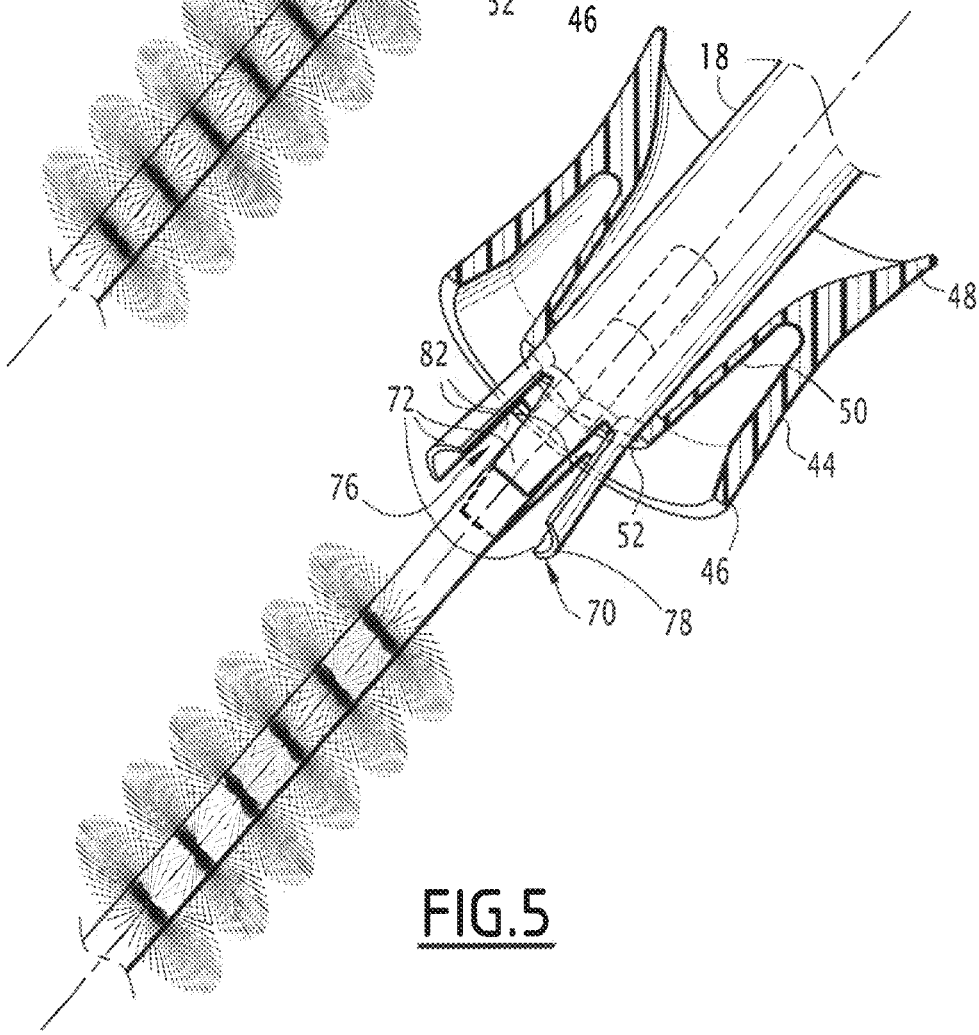

When the force applied to the rod 18 is greater than the reaction force applied by the product to the piston and the friction forces of the piston on the body, the lugs 72 are radially compressed, the ends 78 thereof being guided by the abutment zone 56 of the convergent surface 50 which constitutes a cam surface. This deformation allows the opening 42 to be passed by the stop 70 which is thus retracted as illustrated in FIG. 4. The movement of the applicator continues after the lugs 72 have regained their shape, as illustrated in FIG. 5, by sliding the rod 18 through the opening 42 without additional movement of the piston, until the application element 20 is accommodated in the well 30 and the stopper is screwed to the open end of the receptacle.

It will be appreciated that, when the piston moves, and the retractable stop 70 passes the piston, the pressures at one side and the other of the piston 40 are balanced owing to the circulation of air through the wide recesses 82.

Any pressure differences which could lead to unpleasant sensations are thus prevented.

In a variant, the periphery of the opening 42 comprises axial apertures and the radial widening 70 has no apertures. In this instance, the passage of the radial widening is obtained by means of deformation of the piston around the opening 42.

Figure 6:
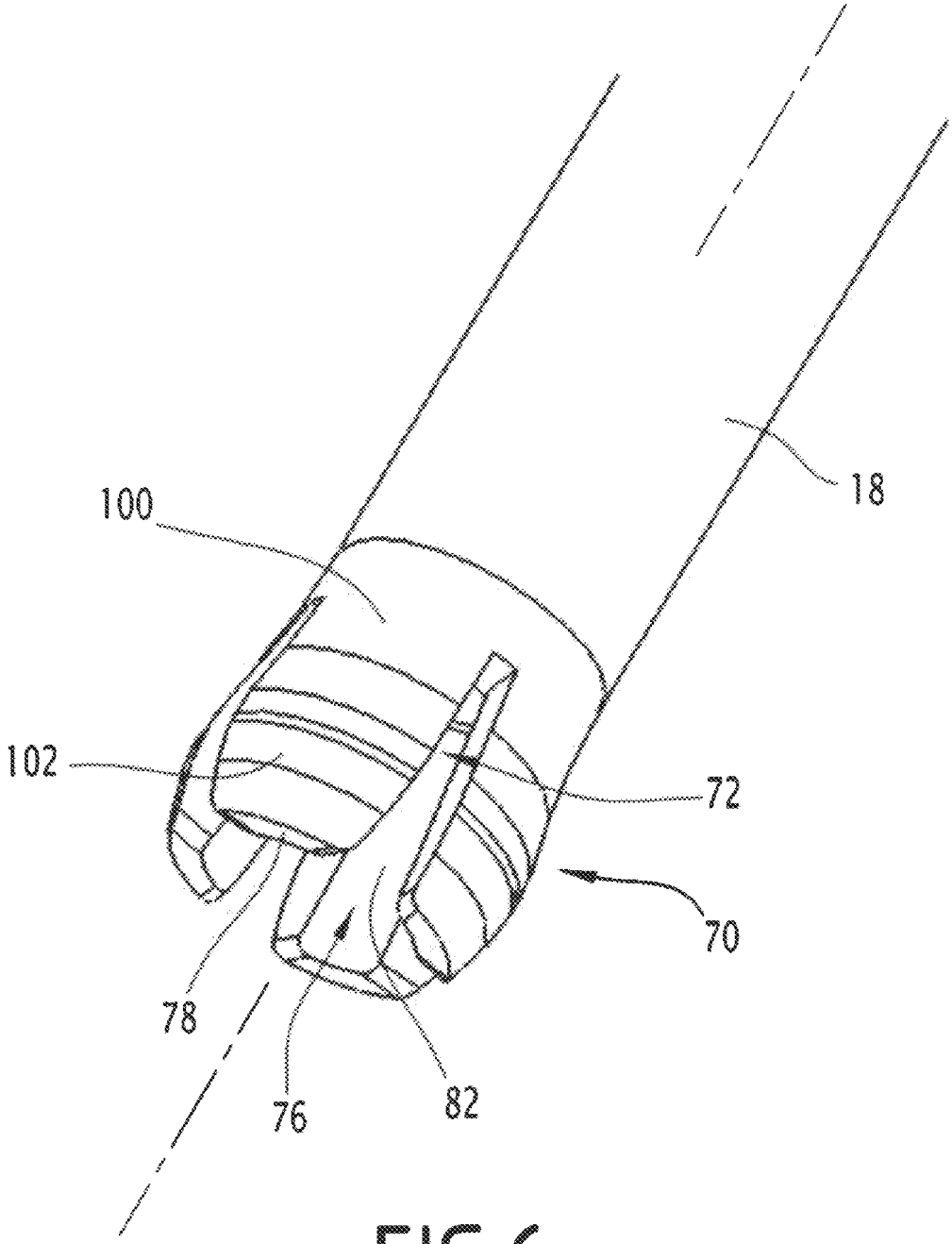
FIG. 6 is a perspective view of the stop of a variation of a packaging device according to the invention.

A variant of application and packaging device 10 is illustrated in FIG. 6. As a difference compared with the device shown in FIGS. 1 to 5, the lugs 72 of the axial stop 70 have externally a bulging shape with a convexity extending in the direction apart from the rod 18 axis.

Each lug 72 converges radially towards the rod 18 axis at its free end 78.

As a consequence, the external surface of each lug 72 comprises a first region 100, connected to the main portion 71 of the rod 18, the first region 100 diverging radially apart from the main portion 71 of the rod 18, and a second region 102, for contacting the piston 40, the second region 102 converging towards the rod 18 axis.

The length of the second convergent region 102, taken along the rod 18 axis, is higher than at least 10% of the length of the first diverging region 100.

When the applicator 14 is inserted in the receptacle 12, the convergent regions 102 of the lugs 72 first enters in contact with the contact zone of the convergent surface 50, which leads to a softer contact with piston 40.

As a consequence, the risk of deterioring piston 40 when reinserting the applicator 14 is lowered.

What is claimed is:

1. Packaging and application device for a product, comprising:

a receptacle for containing the product to be applied;

an applicator comprising a rod which is provided at one end with an application element which can be introduced into the receptacle in order to remove the product, the receptacle comprising:

a tubular body;

a movable piston which is guided axially in the tubular body, which piston defines a passage opening for the application element and the rod, the applicator comprising, along the length of the rod, at least one axial stop which protrudes radially relative to the rod and which is capable of being in abutment against the piston along the periphery of the passage opening, wherein the stop can be retracted radially in order to allow it to pass through the passage opening of the piston and defines at least one orifice for the passage of air when the stop is in abutment against the piston.

2. Packaging and application device according to claim 1, wherein the stop comprises, along the length of the rod, a radial widening which locally increases the cross-section of the rod, and wherein the at least one air passage orifice comprises at least one recess which is provided in the radial widening.

3. Packaging and application device according to claim 2, wherein the radial widening has a plurality of separate lugs which are distributed at the periphery of the rod and which extend away from the shaft of the rod as far as radial tips in the direction of the application element, the lugs being separated by recesses which extend partially along the length of the rod.

4. Packaging and application device according to claim 3, wherein the lugs have at the outer side a surface which diverges radially relative to the shaft of the rod in the direction of the application element.

5. Packaging and application device according to claim 4, wherein the inclination of the lugs relative to the shaft of the rod is between 1 and 10 degrees.

6. Packaging and application device according to claim 5, wherein the rod comprises a tubular casing and the lugs are integral with the tubular casing in the continuation thereof.

7. Packaging and application device according to claim 5, wherein the radial tips constitute the free ends of the lugs.

8. Packaging and application device according to claim 4, wherein the rod comprises a tubular casing and the lugs are integral with the tubular casing in the continuation thereof.

9. Packaging and application device according to claim 8, wherein the radial tips constitute the free ends of the lugs.

10. Packaging and application device according to claim 4, wherein the radial tips constitute the free ends of the lugs.

11. Packaging and application device according to claim 3, wherein the inclination of the lugs relative to the shaft of the rod is between 1 and 10 degrees.

12. Packaging and application device according to claim 11, wherein the rod comprises a tubular casing and the lugs are integral with the tubular casing in the continuation thereof.

13. Packaging and application device according to claim 11, wherein the radial tips constitute the free ends of the lugs.

14. Packaging and application device according to claim 3, wherein the rod comprises a tubular casing and the lugs are integral with the tubular casing in the continuation thereof.

15. Packaging and application device according to claim 14, wherein the radial tips constitute the free ends of the lugs.

16. Packaging and application device according to claim 3, wherein the radial tips constitute the free ends of the lugs.

17. Packaging and application device according to claim 1, wherein the stop is radially resiliently deformable.

18. Packaging and application device according to claim 1, wherein the retractable stop has a resistance to passage through the opening of the piston which is greater when the applicator is introduced into the receptacle than the passage resistance of the retractable stop though the opening of the piston, when the applicator is removed from the receptacle.

19. Packaging and application device according to claim 1, wherein the piston comprises, upstream of the passage opening, when viewed in the direction in which the applicator is introduced into the receptacle, a guiding portion having a cross-section which decreases progressively as far as the passage opening, which portion forms a cam surface which is capable of providing radial retraction of the axial stop by means of co-operation with the stop when the applicator is introduced into the receptacle.

20. Packaging and application device according to claim 1, wherein the passage opening comprises, along the periphery thereof, corrugations which are capable of pressing on the rod.

21. Packaging and application device according to claim 1, wherein that the air passage orifice is able to allow the circulation of air to balance the pressures at one side and the other of piston when the retractable stop passes the piston.

* * * * *